US006004229A

United States Patent [19]

Fazekas

[11] Patent Number: 6,004,229

[45] **Date of Patent: *Dec. 21, 1999**

[54] MULTI-PURPOSE GOLF TOOL AND METHOD

[76] Inventor: Craig A. Fazekas, 39 Varda Landing Rd., Sausalito, Calif. 94965

[ * ] Notice: This patent issued on a continued prosecution application filed under 37 CFR 1.53(d), and is subject to the twenty year patent term provisions of 35 U.S.C. 154(a)(2).
This patent is subject to a terminal disclaimer.

[21] Appl. No.: 08/960,508

[22] Filed: Oct. 29, 1997

Related U.S. Application Data

[63] Continuation of application No. 08/582,672, Jan. 4, 1996, Pat. No. 5,733,208.

[51] Int. Cl.[6] ..... A63B 57/00

[52] U.S. Cl. ..... 473/406; 473/408

[58] Field of Search ..... 473/406, 408, 473/285, 286; D21/234

[56] References Cited

U.S. PATENT DOCUMENTS

| | | | |
|---|---|---|---|
| D. 218,836 | 9/1970 | Watanabe . | |
| D. 237,516 | 11/1975 | Yaudes . | |
| D. 247,686 | 4/1978 | Desjardins . | |
| D. 285,233 | 8/1986 | Owen . | |
| D. 290,985 | 7/1987 | Dikoff . | |
| D. 356,358 | 3/1995 | Woodruff . | |
| D. 361,815 | 8/1995 | Fazekas . | |
| 3,049,182 | 8/1962 | Pelow . | |
| 3,120,388 | 2/1964 | Doble . | |
| 3,203,700 | 8/1965 | Antonious . | |
| 3,233,802 | 2/1966 | Ludwick . | |
| 3,622,157 | 11/1971 | Hatch . | |
| 3,744,542 | 7/1973 | Stephens et al. . | |
| 3,763,515 | 10/1973 | Voss . | |
| 3,774,913 | 11/1973 | Dien . | |
| 4,063,731 | 12/1977 | Kitay . | |
| 4,315,624 | 2/1982 | Buckman | 473/408 |
| 4,386,774 | 6/1983 | Buckman | 473/408 |
| 4,453,294 | 6/1984 | Morita . | |
| 4,530,500 | 7/1985 | Kayman . | |
| 4,535,987 | 8/1985 | Dikoff . | |
| 4,822,052 | 4/1989 | Dimmick et al. . | |
| 4,908,899 | 3/1990 | Killen . | |
| 4,974,842 | 12/1990 | Widman . | |
| 5,022,650 | 6/1991 | Madock . | |
| 5,121,519 | 6/1992 | Haugom . | |
| 5,282,616 | 2/1994 | Stacavich-Notaro . | |
| 5,295,683 | 3/1994 | Tate . | |
| 5,305,999 | 4/1994 | Tate | 473/406 |
| 5,733,208 | 3/1998 | Fazekas | 473/408 |

OTHER PUBLICATIONS

Barlow Catalog 1995, Cover (ASI38480) and p. 23.

*Primary Examiner*—Steven Wong
*Attorney, Agent, or Firm*—Oppenheimer Wolff & Donnelly LLP

[57] ABSTRACT

A multi-purpose golf tool having a round recess with a surrounding wall. A magnetic post in the center of the recess holds a round metallic ball marker in the recess. By pushing down on one edge of the marker an opposite edge is lifted up over the adjacent wall and the marker can be slid forward off of the tool body into a ball marking position. A ribbed or jagged front edge allows the tool to fit into and clean golf club grooves. A pair of elongate rearwardly-extending elongate prongs are uniquely dimensioned and configured to function as both a turf repair tool and as a cleat or spike wrench.

44 Claims, 5 Drawing Sheets

FIG. 10
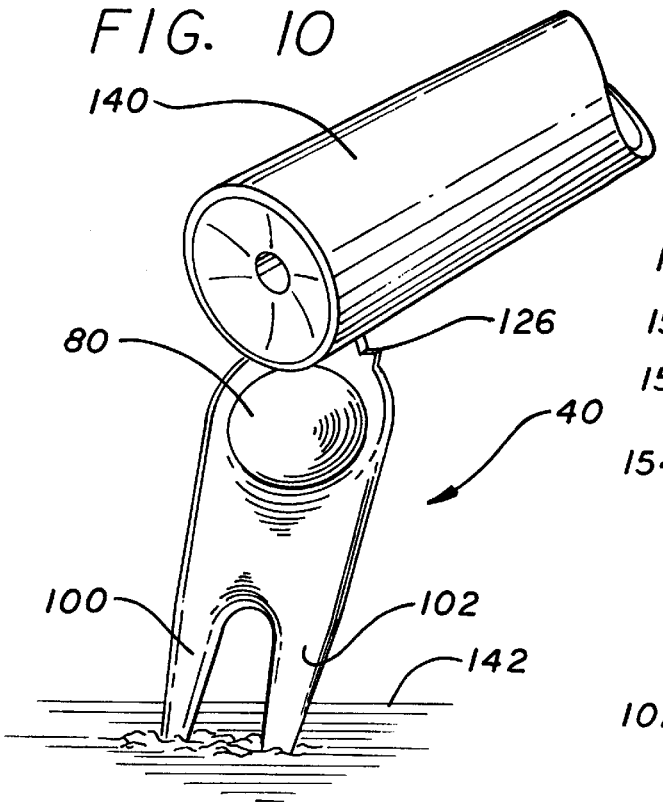
FIG. 11
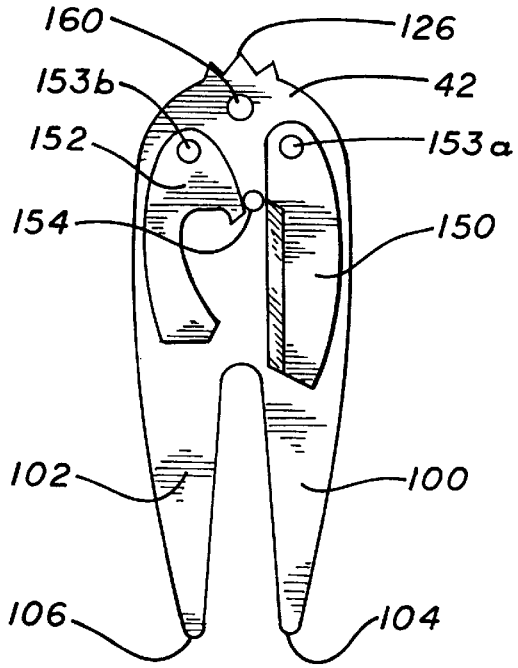
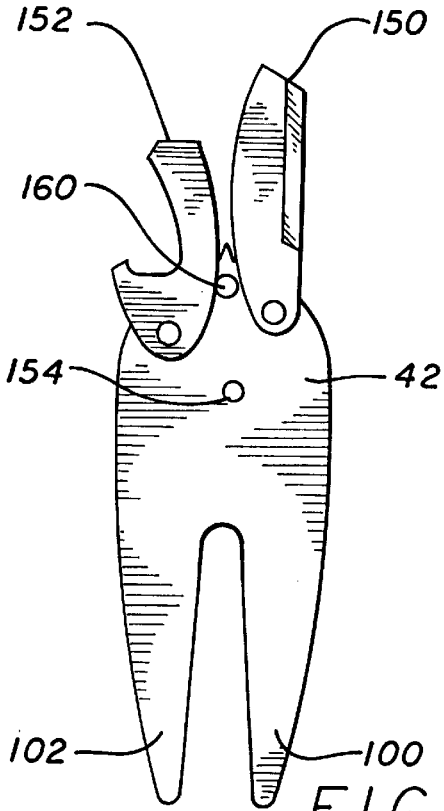
FIG. 12
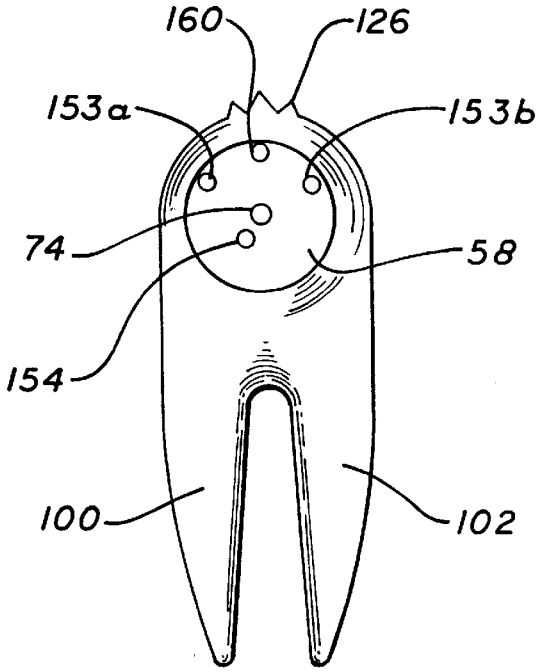
FIG. 13

FIG. 14
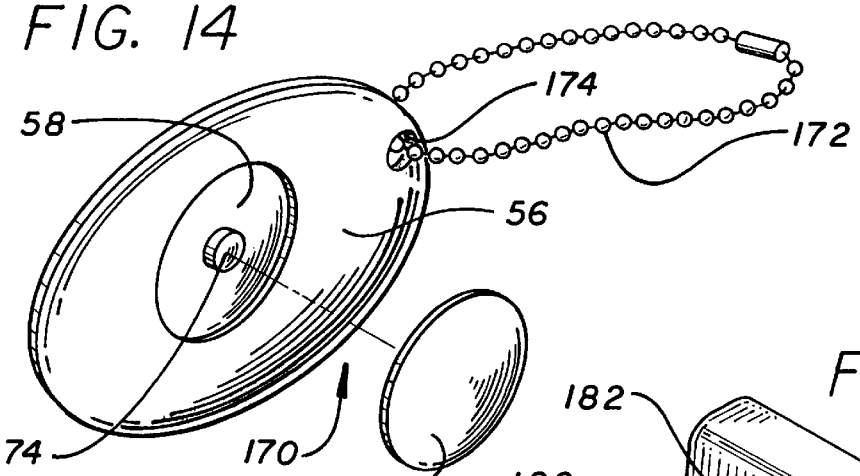
FIG. 15
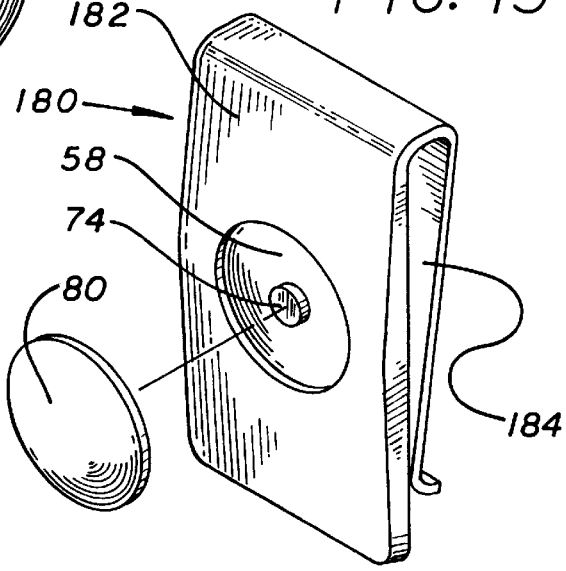
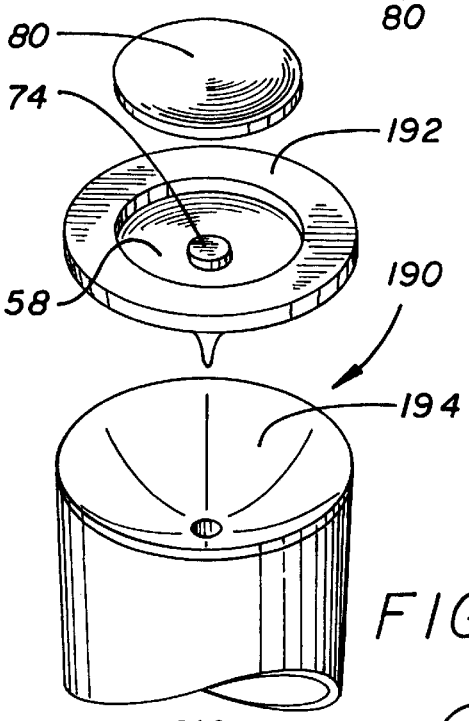
FIG. 16
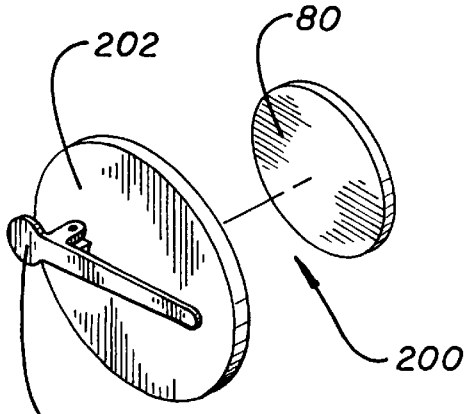
FIG. 17
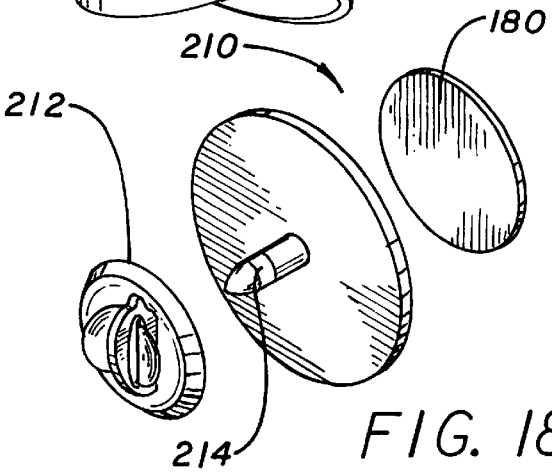
FIG. 18

MULTI-PURPOSE GOLF TOOL AND METHOD

CROSS-REFERENCE TO RELATED APPLICATION

This is a continuation of application Ser. No. 08/582,672, filed Jan. 4, 1996 now U.S. Pat. No. 5,733,208.

BACKGROUND OF THE INVENTION

The present invention relates to golf tools and accessories and more particularly to golf tools having multiple applications and constructed in a single compact apparatus, and to methods of using same.

Numerous different golfers tools have been developed over the years to help the golfer with different activities experienced during golfing play. While some of the tools have only one function, others have multiple functions. The functions can include ball marker holder, club groove cleaner, cleat wrench, cigarette holder, golf club rest, knife and so forth. Examples of some of the prior golf tools are shown in the following patents (each of whose entire disclosure is hereby incorporated by reference): U.S. Pat. Nos. Des. 218,836 (Watanabe), Des. 237,516 (Yaudes), Des. 247,686 (Desjardins), Des. 285,233 (Owen), Des. 290,985 (Dikoff) and Des. 361,815 (Fazekas); and 3,049,182 (Pelow), 3,203,700 (Antonious), 3,744,542 (Stephens et al.), 3,774,913 (Dien), 3,763,515 (Voss), 4,063,731 (Kitay), 4,315,624 (Buckman) and 4,535,987 (Dikoff).

No golf tool has been designed, however, which provides for multiple functions to be conducted efficiently with a simple compact and attractive construction.

SUMMARY OF THE INVENTION

Directed to remedying the problems in and disadvantages of the prior art, an improved multi-purpose golf tool(s) and method(s) of using same are disclosed herein. The tool includes a carrier member having a round recess with a surrounding wall. A magnetic post affixed in the center of the recess releasably holds a round metallic ball marker in place in the recess. To release the marker from the carrier member and quickly, easily and accurately position it on the grass, the user simply pushes down with his thumb on one edge of the marker and then slides it over the post, the adjacent surrounding wall and the front edge of the tool and into position on the grass.

The front edge has a rough (ribbed, jagged, serrated or corrugated) configuration to fit into and clean dirt out of the face grooves of a golf club. Extending rearwardly of the carrier member are a pair of elongate prongs. The prongs and their tips are configured and dimensioned so that the tool can function both as a turf repair tool and uniquely as a cleat or spike wrench. Auxiliary can/bottle opener and/or small knife can be pivotally mounted to the back of the carrier member. The tool, and particularly the ball marker holder arrangement, can be alternatively constructed as a luggage tag, a money clip, a golf club end or a lapel pin.

Other objects and advantages of the present invention will become more apparent to those persons having ordinary skill in the art to which the present invention pertains from the foregoing description taken in conjunction with the accompanying drawings.

BRIEF DESCRIPTION OF THE DRAWINGS

FIG. 10 shows the tool being used as a golf club handle rest;

FIG. 11 is a rear elevational view of an alternative golf tool of the present invention;

FIG. 12 is a view similar to FIG. 11 showing the two auxiliary tools in pivoted operative positions;

FIG. 13 is a front elevational view of the alternative golf tool of FIGS. 11 and 12, with the ball marker removed;

FIG. 14 is a perspective view of an alternative golf tool of the invention constructed as a luggage tag;

FIG. 15 is a perspective view of another alternative golf tool constructed as a money clip;

FIG. 16 is a perspective view of a further alternative golf tool constructed as an end to a golf club;

FIG. 17 is a perspective view of a still further alternative golf tool constructed as a lapel pin; and FIG. 18 is a perspective view of a yet still further alternative golf tool constructed as a lapel pin.

DETAILED DESCRIPTION OF PREFERRED EMBODIMENTS OF THE INVENTION

Figure 1:
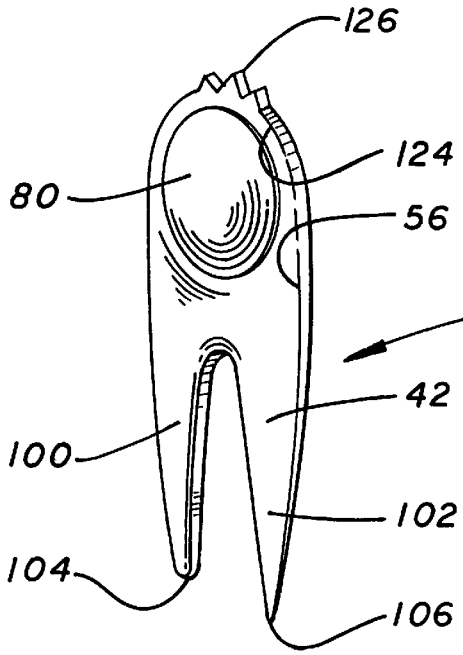
FIG. 1 is a perspective view of a multi-purpose golf tool of the present invention.
Figure 2:
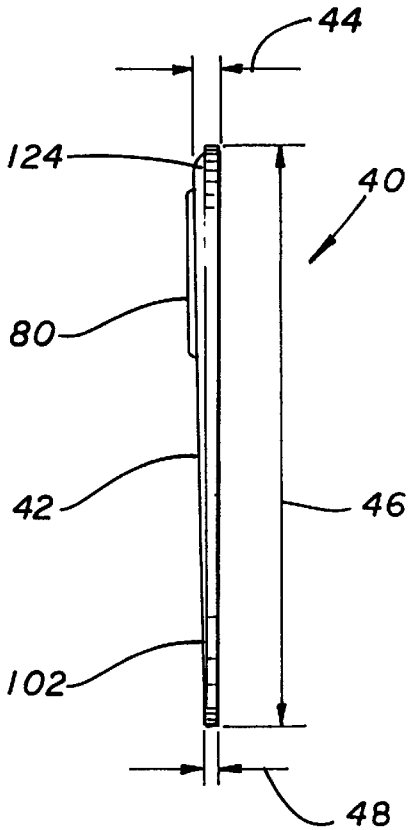
FIG. 2 is a side elevational view thereof.
Figure 3:
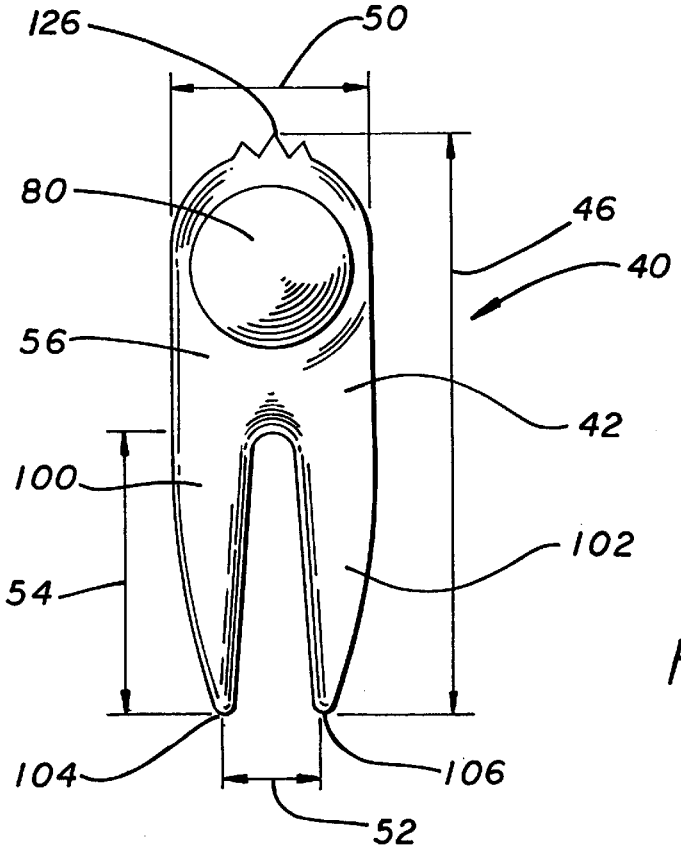
FIG. 3 is a front elevational view thereof.

Referring to the drawings, a number of embodiments of the present invention are illustrated. FIGS. 1–3 show generally at 40 and in isolation a preferred golf tool of the present invention. Golf tool 40 includes a body member 42 preferably formed of solid high quality brass having an 18k gold plating or nickel plating with a tiffany mirror finish and formed by stamping and polishing. The body member has dimensions 44, 46, 48, 50, 52 and 54 of 0.146, 2.7175, 0.045, 0.957, 0.5675 and 1.35 inches, respectively.

Figure 5:
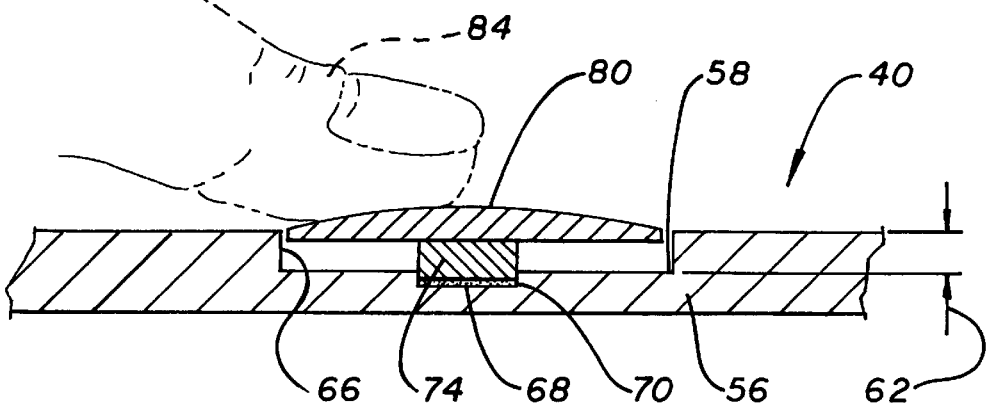
FIG. 5 is an enlarged cross-sectional view of a portion of the tool showing a user's thumb starting a marker release process of the invention.
Figure 6:
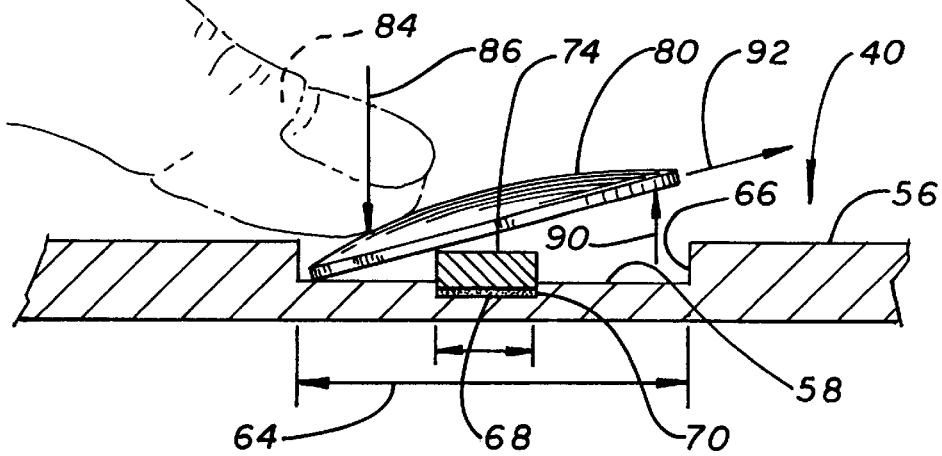
FIG. 6 is a view similar to FIG. 5 showing a subsequent marker release and positioning step.

The body member 42 includes a carrier element, member or portion 56 having a round recess 58 as shown in FIGS. 5 and 6 having a depth 62 of 0.08 inch and a width or diameter 64 of 0.69 inch. A carrier "wall" 66 surrounds the recess 58. The recess 58 has a longitudinal axis intersecting the carrier wall at opposite forward and rearwards ends and a lateral axis intersecting the carrier wall at left and right ends. Affixed by adhesive 68 (for example) in a hole or depression 70 in the center of recess 58 is a round magnetic post 74, comprising a plastiloy/neodymium magnet. As can be best seen in FIG. 5, post 74 has a height above the floor of the recess 58 slightly less than the depth 62 of the recess (that is, the height of the surrounding wall 66).

Figure 4:
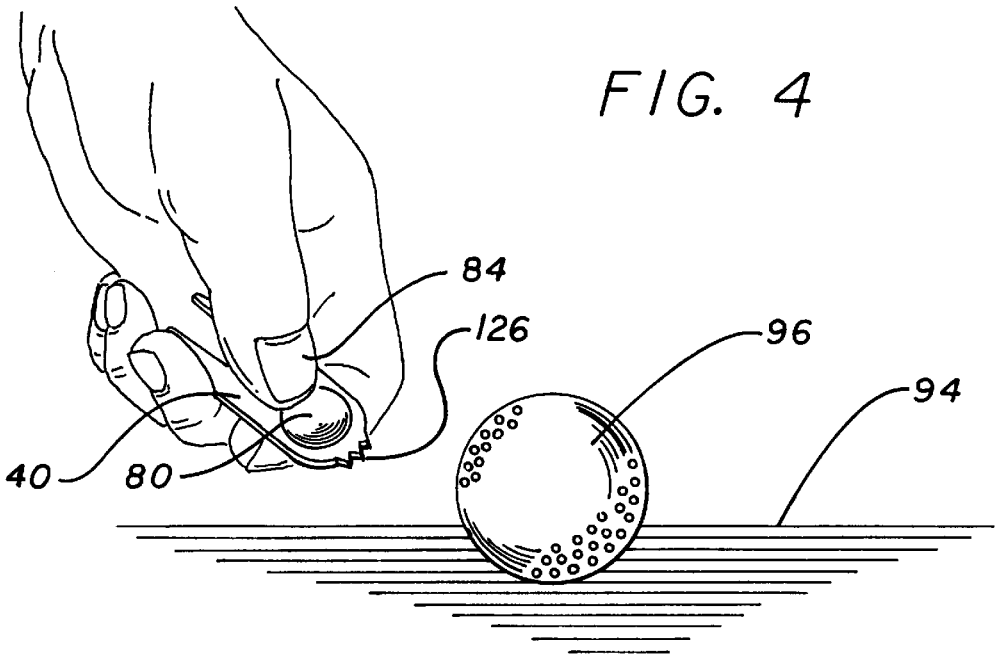
FIG. 4 is a perspective view thereof showing a ball marker thereof being deposited pursuant to this invention.

A round metallic ball marker 80 has a cloisonne or enamel top coating and a diameter of 0.69 inch. It is magnetically held on top of the post 74, as shown in FIG. 5 (and also FIGS. 1 and 3), with its lower surface in the recess 58, below the top of the surrounding wall 66. Then with the user's thumb 84 pressing down on a rear edge of the ball marker 80, as shown in FIG. 6 by arrow 86, the forward edge of the ball marker is lifted up as shown by arrow 90, with the magnetic post 74 acting as a fulcrum. The marker 80 can then be slid forward as shown by arrow 92, off of the forward edge of the body member 42 onto the grass 94 at the location of the golf ball 96 as can be understood from FIG. 4.

Figure 7:
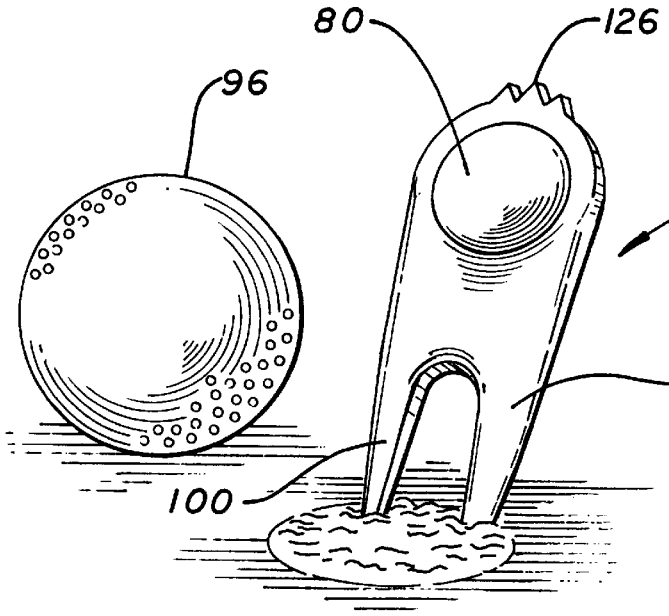
FIG. 7 is a perspective view showing the tool of FIG. 1 in a golf turf repair procedure, that is, used as a divot mender.

Extending rearwardly of the carrier element 56, and as part of the body member 42 are a pair of elongate tines or prongs 100, 102, having respective tips 104, 106. The prongs 100, 102 are long enough and otherwise dimensioned so that they can be pressed into the golf green or turf 110 and manipulated to re-form or repair damaged turf, and this procedure is illustrated in FIG. 7. Thereby the golf tool 40 functions as a divot mender.

Figure 8:
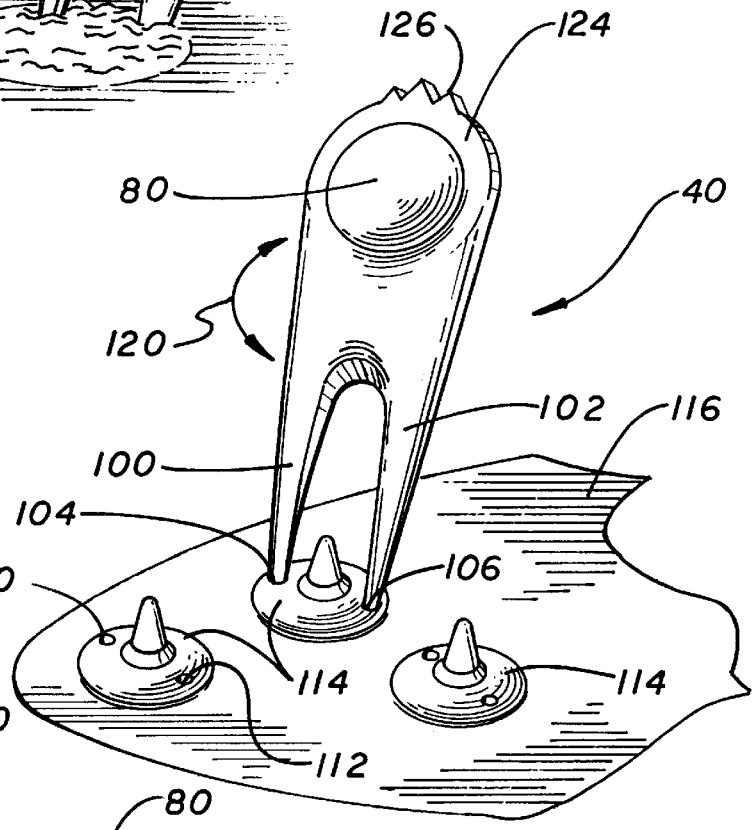
FIG. 8 is a perspective view of the tool in a golf shoe cleat or spike wrench procedure.

Referring to FIG. 8, the tips 104, 106 are also pointed and uniquely spaced 25 apart (as shown by dimension 52) to fit onto existing openings 110, 112 in cleats or spikes 114 in the bottoms of golf shoes 116. With the tips 104, 106 in place, the body member 42 can be turned as shown by arrow 120 to loosen or tighten the cleats or spikes 114. Thereby the golf tool 40 functions in a unique manner as a cleat or spike wrench.

Figure 9:
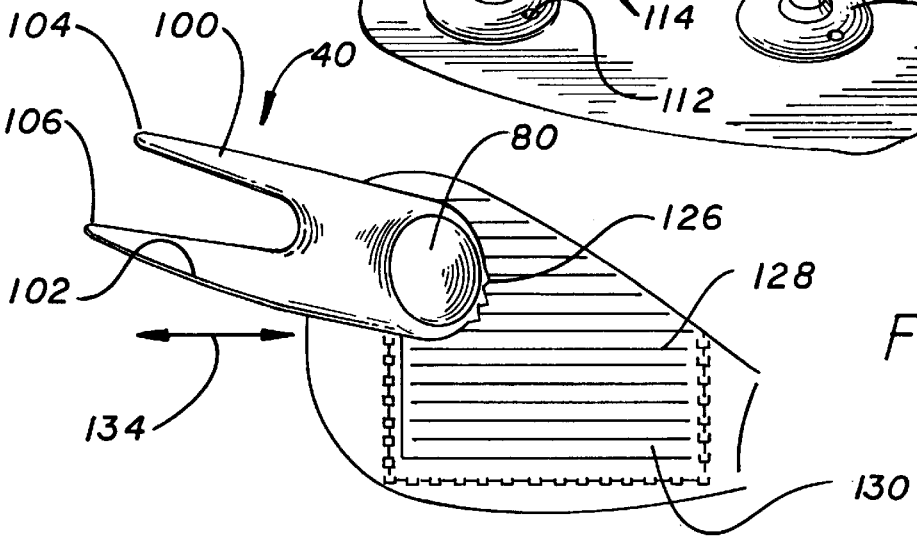
FIG. 9 shows the tool in a golf club face cleaning procedure, that is, used as a club groove cleaner.

The forward arcuate end 124 of the carrier element 56 (or body member 42) has a jagged, serrated, rough or ribbed configuration. The jags or ribs 126 are dimensioned to fit into the grooves 128 in the face of a golf club 130, as depicted in FIG. 9. And by moving the body member 42 back and forth as illustrated by arrow 134, the dirt or mud can be quickly cleaned out of the grooves 128. Thereby the golf tool 40 functions as a groove cleaner.

With the prongs 100, 102 inserted part way into the ground, golf club handle 140 can be held or supported by the ribs 126 conveniently off of the wet or chemically treated grass 142, as shown in FIG. 10.

Golfers also often desire to have convenient easy access to other tools. Accordingly an alternative embodiment of this invention provides for a small knife 150 and/or a bottle/can opener 152 to be pivotally attached at respective pivot points to the back side of the body member 42. The knife 150 and opener 152 can be pivoted about respective rivets 153*a,* 153*b* into folded-in positions safely not protruding out beyond the perimeter of the body member 42, as shown in FIG. 11, and against opposite sides of an abutment post or bump 154. The knife 150 and bottle/can opener 152 can then be folded out to respective accessible operative positions and against another abutment post or bump 160. Although FIG. 12 shows both the knife/file 150 and opener 152 simultaneously in open positions, it is expected for convenience and safety reasons that only one would be out at a time. FIG. 13 shows, in the recess 58, the indent sides of the bumps 154, 160, and the opposite ends of the rivets 153*a,* 153*b*.

FIGS. 1–13 show embodiments with the body member 42 as a separate tool, to be carried preferably in a protective felt pouch (not shown) in the user's pocket. Other packaging options include a clear plastic case, a leather sheath or a velvet jewelry box. Alternative embodiments of the carrier element 56 are shown in FIGS. 14–18. Referring thereto it is seen that a similar recess 58, surrounding wall 66 and magnetic post 74 are provided for the ball marker 80. The prongs (100, 102) and ribs (126) are omitted however, and a different carrying construction and/or secondary use are provided.

FIG. 14 shows generally at 170 the carrier element 56 forming a luggage tag. A chain or loop 172 passes through an opening 174 for attachment to a luggage handle (not shown). The user or owner's name, address or other identifying information can be affixed to or otherwise provided on the opposite side of the carrier element 56.

A money clip embodiment is shown generally at 180 in FIG. 15. The recess 58 is provided on the rear face of the body portion 182 of the clip 180 and the resilient clip portion 184 is attached to the body portion and functions in a known manner to hold folded paper money (not shown).

Similarly, FIG. 16 shows generally at 190 a (circular) carrier element 192 (or 56) mounted on top of a golf club 194 with a tapered mounting pin 196.

A lapel pin embodiment is illustrated generally at 200 in FIG. 17. It includes (similar to FIG. 15) a carrier element 202 (or 56) and a magnetic post (74) for a ball marker 80. Instead of the tapered mounting pin (196), it has a press-down clip 204 on the back.

FIG. 18 shows at 210 an alternative lapel pin embodiment, which includes a carrier element 210 and a conventional pinch-in butterfly clip 212. When the tabs of the clip 212 are pinched together, the clip fits onto the pin or post 214 on the back of the carrier element 210. And when they are released the clip 212 fixes onto the post 214.

From the foregoing detailed description, it will be evident that there are a number of changes, adaptations and modifications of the present invention which come within the province of those skilled in the art. However, it is intended that all such variations not departing from the spirit of the invention be considered as within the scope thereof as limited solely by the claims appended hereto.

What is claimed is:

1. A golf tool, comprising:

a carrier member;

a recess on said carrier member;

a permanent-magnet post secured in said recess; and a metallic ball marker positionable in a held position magnetically held to a top of said post generally in said recess such that said ball marker can be manually pushed with a sliding motion generally on said post, and off said post and said carrier member into a desired golf ball marking position;

wherein said ball marker has a diameter larger than a diameter of said post;

wherein said ball marker when in the held position is generally centered on said post; and wherein said post is secured in a center of said recess whereby when said ball marker is in the held position, any desired edge of said ball marker about an entire circumference of said post can be depressed into said recess at a depression location and said ball marker then pushed off of said post and said carrier member at a location on an opposite side of said carrier member as said depression location and into the desired golf ball marking position.

2. The tool of claim 1 further comprising a pair of elongate tapered prongs extending out from said carrier member, and having pointed ends spaced relative to one another and dimensioned to fit into corresponding recesses in a golfing shoe spike for removal of the spike by turning said carrier member.

3. The tool of claim 2 wherein said prongs are each approximately 1.35 inches long, and said prongs have their respective prong tips spaced 0.5675 inch apart.

4. The tool of claim 2 wherein said magnetic post is affixed in a hole in a center of said recess.

5. The tool of claim 1 wherein said permanent-magnet post is a neodymium magnet post.

6. The tool of claim 1 wherein said carrier member has a forward end and an opposite rearward end, said ball marker is slid off said forward end into the desired golf ball marking position, and further comprising elongate prongs extending back from said rearward end and dimensioned and configured to act directly as a spike wrench and as a turf repair tool.

7. The tool of claim 6 wherein said elongate prongs include a pair of elongate prongs each 1.35 inch long and having respective tips spaced 0.5675 inch apart.

8. The tool of claim 1 wherein said carrier member has an arcuate forward edge with jagged means for scrape-cleaning grooves in golf club faces.

9. The tool of claim 8 wherein said forward edge is adjacent to a portion of a carrier member wall up over which said ball marker is lifted.

10. The tool of claim 1 wherein said ball marker has a rounded top surface.

11. The tool of claim 1 wherein said carrier member includes a carrier member wall encircling said recess.

12. The tool of claim 1 wherein said carrier member defines a luggage tag connectable to a luggage loop connector.

13. The tool of claim 1 wherein said carrier member is a money clip having an angled biased paper money-holding component.

14. The tool of claim 1 wherein said carrier member is secured on a golf club end.

15. The tool of claim 1 wherein said carrier member has a clip on a rear side thereof.

16. The tool of claim 15 wherein said carrier member comprises a lapel pin.

17. The tool of claim 1 further comprising said carrier member having a forward edge and rearward end; and a pair of elongate turf-repair prongs extending rearwardly from said rearward end, said prongs having tips thereof being spaced relative to one another to fit into golf shoe cleats and when said carrier member is then turned to thereby act as a spike wrench; wherein said prongs are approximately 1.35 inches long and the distance between said tips is 0.5675 inch.

18. The tool of claim 17 wherein said forward edge has a jagged edge configuration to form a golf club head cleaning surface.

19. The tool of claim 1 wherein the diameter of said post is substantially less than a diameter of said recess.

20. A golf play method, comprising the steps of:

providing a golf tool including a carrier member having a recess and a magnetic post secured in a center of the recess, and a metallic ball marker magnetically attached on the magnetic post in a held position, the ball marker having a diameter larger than a diameter of the magnetic post and smaller than a diameter of the recess;

selecting an edge portion of the ball marker when in the held position at any location about an entire circumference of the magnetic post;

depressing the edge portion down into the recess at a depression location; and after said depressing, sliding the ball marker off of the magnetic member and off of the carrier member at a location generally opposite to the depression location and into a desired golf ball marking position.

21. The method of claim 20 further comprising the golf tool including a pair of rearwardly-extending elongate prongs having prong tips, the prongs being more than an inch long; inserting the tips into golf shoe spike openings and turning the carrier member, and thereby using the carrier member as a spike wrench; and inserting the prongs a distance into damaged golf turf and manipulating the inserted prongs to at least partially repair the turf.

22. The method of claim 21 wherein the prongs are 1.35 inches long and the tips are 0.5675 inch apart.

23. The method of claim 21 further comprising said golf tool being in a first position on a user's hand during said sliding step and in a second position in the user's hand rotated one hundred and eighty degrees from the first position during said tips inserting step.

24. The method of claim 21 wherein a forward end of the carrier member opposite to the prongs includes a ribbed surface, and further comprising cleaning a golf club face with the ribbed surface.

25. The method of claim 20 wherein said sliding is off of a forward end of the carrier member, and the carrier member has a pair of rearwardly-extending elongate prongs having tips, and further comprising using the prong tips and the carrier member as a golf shoe cleat wrench.

26. The method of claim 25 wherein the forward end includes a ribbed surface, and further comprising cleaning a golf club face with the ribbed surface.

27. The method of claim 25 further comprising inserting the prongs into damaged golf turf and manipulating the prongs and thereby repairing the turf.

28. A golf play method, comprising the steps of:

providing a golf tool including a carrier member having a recess and a magnetic post generally in a center of the recess, and a metallic ball marker magnetically attached on the post in a held position, the ball marker having a diameter larger than that of the magnetic post and less than that of the recess;

with the ball marker in the held position, pushing down on an edge of the ball marker at any location about an entire circumference of the magnetic post and into the recess and thereby lifting an opposite end thereof relative to the post; and sliding the lifted opposite end and thereby the ball marker off of the carrier member and into a desired golf ball marking position.

29. The method of claim 28 wherein the carrier member has a wall encircling the recess, and said sliding includes moving the ball marker over the wall.

30. The method of claim 28 wherein the diameter of the recess is substantially greater than that of the magnetic post.

31. A golf tool, comprising:

a carrier member having a recessed well, said recessed well having a well floor;

a permanent-magnet post secured in said recessed well and extending up from said well floor;

said post having a largest diameter thereof being substantially less than a largest diameter of said recessed well;

a metallic ball marker positionable in a held position magnetically held to a top of said post and generally in said recessed well;

said recessed well having a longitudinal axis intersecting said recessed well at opposite forward and rearward ends thereof;

said recessed well having a lateral axis intersecting said recessed well at left and right ends thereof;

said post being spaced inwardly a distance from the left end;

said post being spaced inwardly a distance from the right end; and said post being spaced inwardly a distance from the rearward end such that when said ball marker is in the held position, a rear end thereof can be manually depressed down into said recessed well between the rearward end and said post and pushed with a sliding motion off of said post, off of a forward end of said carrier member and into a ball marking position.

32. The tool of claim 31 wherein said post is positioned on the longitudinal axis.

33. The tool of claim 31 wherein said well floor includes a hole, and said post is mounted in said hole.

34. The tool of claim 33 wherein said hole has a diameter thereof being substantially less than a diameter of said well floor.

35. The tool of claim 31 wherein said post has a smallest diamater thereof which substantially less than a smallest diameter of said recessed well.

36. The tool of claim 31 wherein when said ball marker is in the held position, a left edge thereof can be manually depressed down into said recessed well between the left end and said post and pushed with a sliding motion off of said post, off of a right side of said carrier member and into a ball marking position.

37. The tool of claim 36 wherein when said ball marker is in the held position, a right edge thereof can be manually depressed down into said recessed well between the right end and said post and pushed with a sliding motion off of said post, off of a left side of said carrier member and into a ball marking position.

38. The tool of claim 31 wherein said permanent-magnet post is a neodymium magnet post.

39. The tool of claim 31 wherein said carrier member at a forward end thereof has jagged means for scrape-cleaning grooves in golf club faces.

40. The tool of claim 31 wherein said post extends up from said floor to a height below a height of a wall of said recessed well.

41. The tool of claim 31 further comprising a pair of elongate tapered prongs extending out from said carrier member, and having pointed ends spaced relative to one another and dimensioned to fit into corresponding recesses in a golfing shoe spike for removal of the spike by turning said carrier member.

42. The tool of claim 41 wherein said prongs are each approximately 1.35 inches long, and said pointed ends are spaced approximately 0.5675 inch apart.

43. The tool of claim 31 wherein said post is positioned on the lateral axis.

44. The tool of claim 31 wherein said post is cylindrical.

* * * * *